US008388352B1

(12) United States Patent
ChongYu et al.

(10) Patent No.: US 8,388,352 B1
(45) Date of Patent: Mar. 5, 2013

(54) DUCK HEAD CONNECTOR

(75) Inventors: Gong ChongYu, Shenzen (CN); Liu GengYang, Shenzen (CN); Mui Lian Jessica Toh, Singapore (SG)

(73) Assignee: Volex plc, London (GB)

( * ) Notice: Subject to any disclaimer, the term of this patent is extended or adjusted under 35 U.S.C. 154(b) by 55 days.

(21) Appl. No.: 13/247,460

(22) Filed: Sep. 28, 2011

(51) Int. Cl.
*H01R 39/00* (2006.01)

(52) U.S. Cl. ..... 439/11; 439/13; 439/638

(58) Field of Classification Search ..... 439/11, 439/13–14, 18, 21, 332, 625, 638
See application file for complete search history.

(56) References Cited

U.S. PATENT DOCUMENTS

| | | | |
|---|---|---|---|
| D308,962 | S | 7/1990 | Duk |
| 5,420,493 | A | 5/1995 | Hargadon et al. |
| 5,616,051 | A | 4/1997 | Rogers et al. |
| 5,658,152 | A | 8/1997 | Selker |
| D408,786 | S | 4/1999 | Goto |
| D478,310 | S | 8/2003 | Andre et al. |
| 6,821,134 | B2 | 11/2004 | Chen |
| 7,435,090 | B1 | 10/2008 | Schriefer et al. |
| 7,488,178 | B2 | 2/2009 | Inotsuka |
| 7,497,707 | B2 | 3/2009 | Wu et al. |
| 7,573,159 | B1 | 8/2009 | Deluliis et al. |
| 7,575,436 | B1 | 8/2009 | Devlin et al. |
| 7,658,625 | B2 | 2/2010 | Jubelirer et al. |
| 7,740,484 | B1 | 6/2010 | Chiang |
| 2007/0091545 | A1 | 4/2007 | Wong |
| 2011/0053421 | A1 | 3/2011 | Mostoller et al. |

FOREIGN PATENT DOCUMENTS

| | | |
|---|---|---|
| EP | 0 818 854 | 1/1998 |

*Primary Examiner* — Khiem m Nguyen
(74) *Attorney, Agent, or Firm* — Woodcock Washburn LLP

(57) ABSTRACT

Embodiments are directed to a duck head connector comprised of a connector for connecting to a power adapter and an electric plug that swivels about the face of the side of the plug, where flexible insulated wires connect the prongs of the electric plug with the contacts of the connector. The flexible insulated wires rotate together with the plug, with the length and shape of the wires enabling the wires to wrap around each other without becoming tangled. In an alternative embodiment, a pair of spring contacts connects the prongs of the electric plug with a pair of stationary half-ring contacts. The spring contacts swivel along the inner surface of the half-ring contacts when the plug rotates. Flexible insulated wires connect the stationary half-ring contacts to the contacts of the connector.

21 Claims, 14 Drawing Sheets

DUCK HEAD CONNECTOR

CROSS-REFERENCES TO RELATED APPLICATIONS

Not applicable.

BRIEF DESCRIPTION OF THE INVENTION

An embodiment is directed to a duck head connector comprised of a connector for connecting to a power adapter and an electric plug that swivels about the face of a side of the plug. In an embodiment, flexible insulated wires connect the prongs of the electric plug with the contacts of a C7 connector or other type of connector. The flexible insulated wires rotate together with the plug, with the length and shape of the wires enabling the wires to wrap around each other without becoming tangled. In an alternative embodiment, a combination of rotary and stationary contacts is used for the connection between the prongs of the electric plug and the contacts of the connector. A pair of spring contacts connects the prongs of the electric plug with a pair of stationary half-ring contacts. The spring contacts swivel along the inner surface of the half-ring contacts when the plug rotates. Flexible insulated wires connect the stationary half-ring contacts to the contacts of the connector. In embodiments disclosed herein, a latch plate or an alternative fastening mechanism can be used to restrict the range of rotation of the plug and to secure the plug at a particular position.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

Electronic devices, and specifically portable electronic devices, rely on power adapters for operating from the power mains and for charging the batteries of the devices. Different adapters are used for different devices depending on the type of device, the device power requirements and the country/countries in which the device is sold/used. Along with the different types of devices, adapters have been designed and configured to operate in different ways. For instance, various adapters include the ability to rotate or fold the prongs to increase the flexibility of uses for the adapter. Yet, the physical structure used to provide this functionality varies widely. Various examples are provided below.

U.S. Design Pat. D.308,962 shows the ornamental design of an electrical adapter plug, with the prongs of the plug capable of being adjusted about a pivot point. U.S. Design Pat. D.408,786 shows the ornamental design for a C7 connector. The prongs of the connector move along a single axis between an extended position and a folded position—the prongs folding into the body of the connector. However, the motion of the prongs is not about the face of the plug.

U.S. Pat. No. 5,420,493 is reputed to be owned by APPLE and teaches a duck head socket adapter. The duck head socket adapter attaches to an AC adapter and battery charger for a portable system. The duck head socket adapter is static and none of its parts move linearly or swivel. U.S. Pat. No. 5,616,051 is also reputed to be owned by APPLE and teaches an AC adapter having prongs that rotate along a pivot to enable the prongs to fold into a recess in the device. This feature is used for storage when the prongs are not being used, as illustrated in FIGS. 1 and 2. It also noted that the rotation of the prongs is not about the face of the adapter.

U.S. Pat. No. 5,658,152 teaches a plug having a female plug plugging into an adapter and a male plug plugging into a receptacle with the female plug and the male plugs rotating 180 degrees with respect to each other. A series of notches and dimples are used to maintain electrical contact between the female plug and the male plug during rotation.

U.S. Pat. No. 6,821,134 teaches a rotatable plug that rotates parallel to the face of the plug. The patent teaches that each prong is connected to a conductive terminal, and the conductive terminal itself is connected to a conductive wire. However, the conductive wires are never shown in any of the figures. In addition, the conductive wires do not serve a role in implementing or enabling the rotation of the face of the plug.

U.S. Pat. No. 7,497,707 teaches a C7 connector, with the prongs of the connector rotating to enable the prongs to fold into the body of the connector. The patent describes a complex arrangement of interlocking connecting elements that maintain the electrical connection when the prongs are rotated.

U.S. Pat. No. 7,573,159 teaches an APPLE duck head C7 power adapter. The prongs are moveable along an axis for enabling the prongs to be folded into the body of adapter or to be extended, but the prongs do not rotate about the face of the plug. U.S. Pat. No. 7,575,436 teaches an electrical plug adapter with a rotating cap. The patent describes the use of rotary contacts to maintain the electrical connection with the prongs of the plug.

U.S. Pat. No. 7,658,625 teaches an AC power adapter that includes prongs that swivel about the body of the adapter and that also fold into the body of the adapter for storage. U.S. Pat. No. 7,740,484 teaches a rotating receptacle that uses ring-shaped contact regions to maintain continuously electrical contact with the conductor terminals of the receptacle.

A large number of the references disclosed herein teach connectors whose prongs move linearly or rotate between an extended position and a recessed position (the prongs folded into the body of the connector). Numerous other references teach swiveling of the plug about the face of the plug, but these references either do not disclose how electrical contact is maintained with the prongs of the plug or teach complicated designs, involving numerous static and moving parts, to ensure that electrical connection is maintained even as the plug is rotated. These complicated designs taught by the relevant references increase manufacturing costs due to the increased complexity of assembly. In addition, the more parts involved in a design, the higher the probability that one of those parts will malfunction. It is desirable to have a C7 power adapter with a simple, less complicated design that decreases the number of parts needed to implement rotation of the prongs of the plug while maintaining an electrical connection.

DETAILED DESCRIPTION OF THE INVENTION

Figure 1:
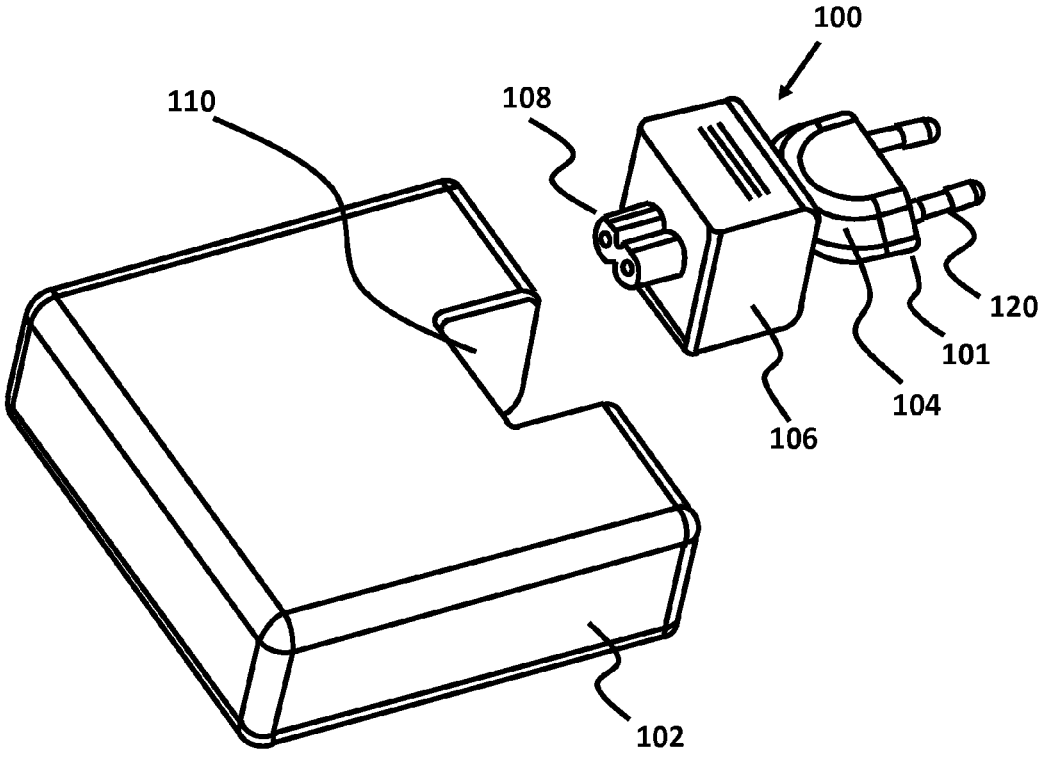
FIG. 1 illustrates an embodiment of a duck head connector and a corresponding rectangular power adapter.

An embodiment is directed to a duck head connector comprised of a connector for connection to a power adapter and an electric plug that swivels about the face of the side of the plug, where the connector and the electric plug are connected by flexible insulated wires. While this embodiment is directed to a duck head connector for a C7 connector type that mates with a C8 inlet type of the adapter, the invention is not limited to a C7 connector type. Accordingly, other types of connectors could also be used in the duck head connector without departing from the present invention, including C1, C5, C9, C13, C15, C15A, C17, C19, C21 and C23 type connectors, as well as other connectors that have not yet been developed, but would work within the duck head connector of the present invention. Likewise, the plug could be any of a number of different types of electric plugs, including Type A, Type B, Type C, Type D, Type E, Type F, Type G, Type H, Type I, Type J, Type K, Type L, and Type M, as well as other electric plugs that have not yet been developed.

In an embodiment, flexible insulated wires connect the prongs of the electric plug with the contacts of a C7 connector. The flexible insulated wires rotate together with the plug, with the length and shape of the wires enabling the wires to wrap around each other without becoming tangled. In an alternative embodiment, a combination of rotary and stationary contacts is used for the connection between the prongs of the electric plug and the contacts of the C7 connector. A pair of spring contacts connects the prongs of the electric plug with a pair of stationary half-ring contacts. The spring contacts swivel along the inner surface of the half-ring contacts when the plug rotates. Flexible insulated wires connect the stationary half-ring contacts to the contacts of the C7 connector. In embodiments disclosed herein, a latch plate or an alternative fastening mechanism can be used to restrict the range of rotation of the plug and to secure the plug at a particular position.

The plugs and connectors presented above in the Background Section consist of complicated designs, involving numerous static and moving parts to ensure that electrical connection is maintained as the plug of the connectors is rotated. These plugs and connectors increase manufacturing costs due to the increased complexity of assembly. In addition, the more parts involved in a connector, the higher the probability that one of those parts will malfunction. Finally, many of these connectors enable rotation of the prongs of the plug to enable the prongs to fold into the body of the connector, and not to enable the plug to rotate to an optimal orientation when connecting the plug or connector to an electric socket.

Embodiments of the duck head connector disclosed herein improve and provide a compact electric plug for a device using a polarized C8 inlet. Flexible insulated wires connect the prongs of the electric plug to the contacts of the C7 connector, with the wires rotating with rotation of the plug. Thus, embodiments minimize the number of movable parts needed to maintain electrical connection as the plug is rotated. In an alternative embodiment, a combination of rotary and stationary contacts is used for the connection between the plug and the C7 connector. Spring contacts connect the prongs of the plug to stationary half-ring contacts. Stationary flexible insulated wires connect the stationary half-ring contacts to the contacts of the C7 connector.

FIG. 1 illustrates an embodiment of a duck head connector 100 interfacing with a rectangular power adapter 102. The duck head connector 100 is comprised of an electrical plug 101 and a C7 connector 108. The adapter 102 is presented for illustration purposes. It is noted that a power adapter need not be shaped or resemble the adapter 102 illustrated in FIG. 1. Regardless of the shape of the adapter 102, the adapter 102 at least includes an inlet (not shown) for connecting with the connector of the duck head connector 100. The power adapter 102 operates as a power supply, which may or may not include a transformer or other means of converting different voltages and currents of the AC power to DC power. Many modern power supplies are switched mode supplies capable of converting 110-240 V AC power from a main supply to several output DC voltages and would therefore work with a range of different connectors and inlets. In the present illustration, however, if the connector 108 is a C7 connector, then the inlet of the adapter 102 would be a C8 inlet. In addition, if a device does not make use of an adapter 102, and the device itself could include an appropriate inlet, such as a C8 inlet, then the duck head connector 100 could be connected directly to the C8 inlet of the device.

Figure 8:
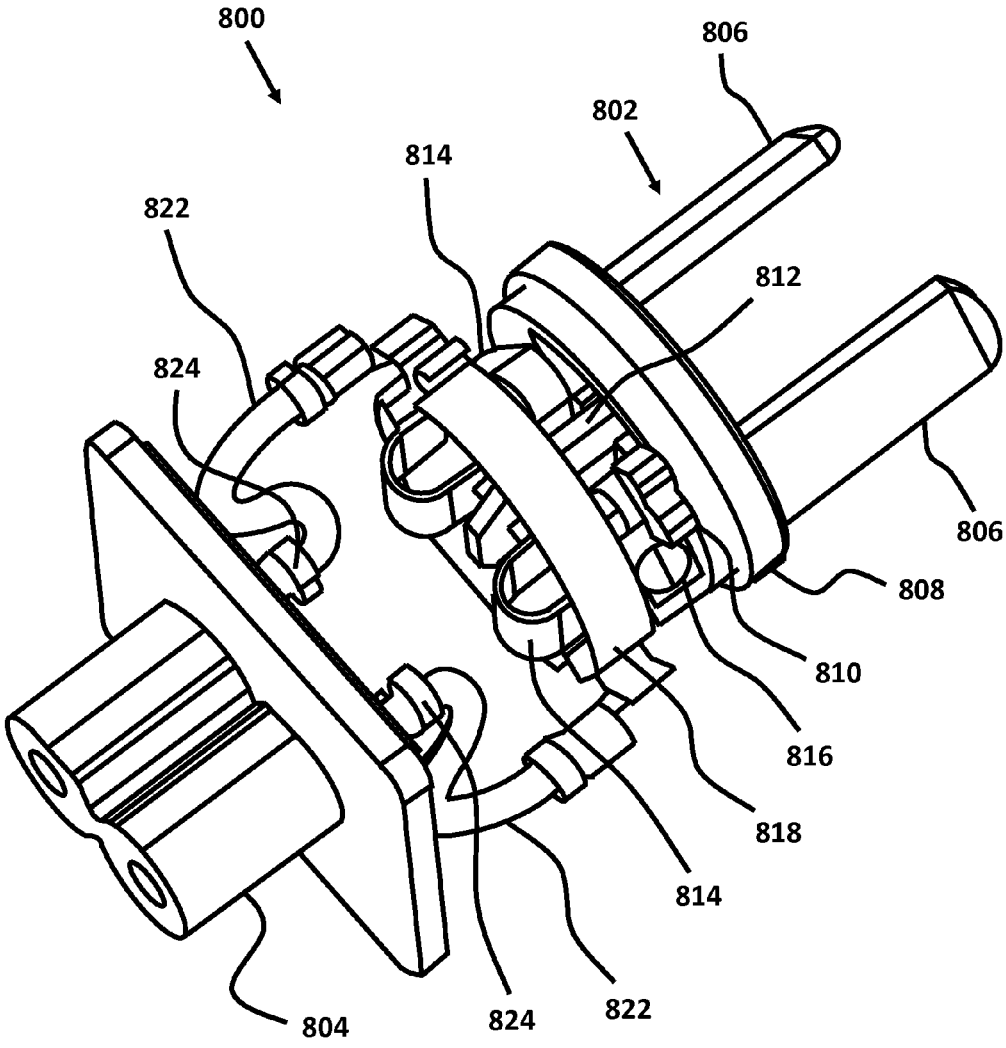
FIG. 8 illustrates an alternative embodiment of a duck head connector using spring contacts swiveling along the inner surface of half-ring contacts to maintain electrical contact when the plug is rotated.
Figure 9:
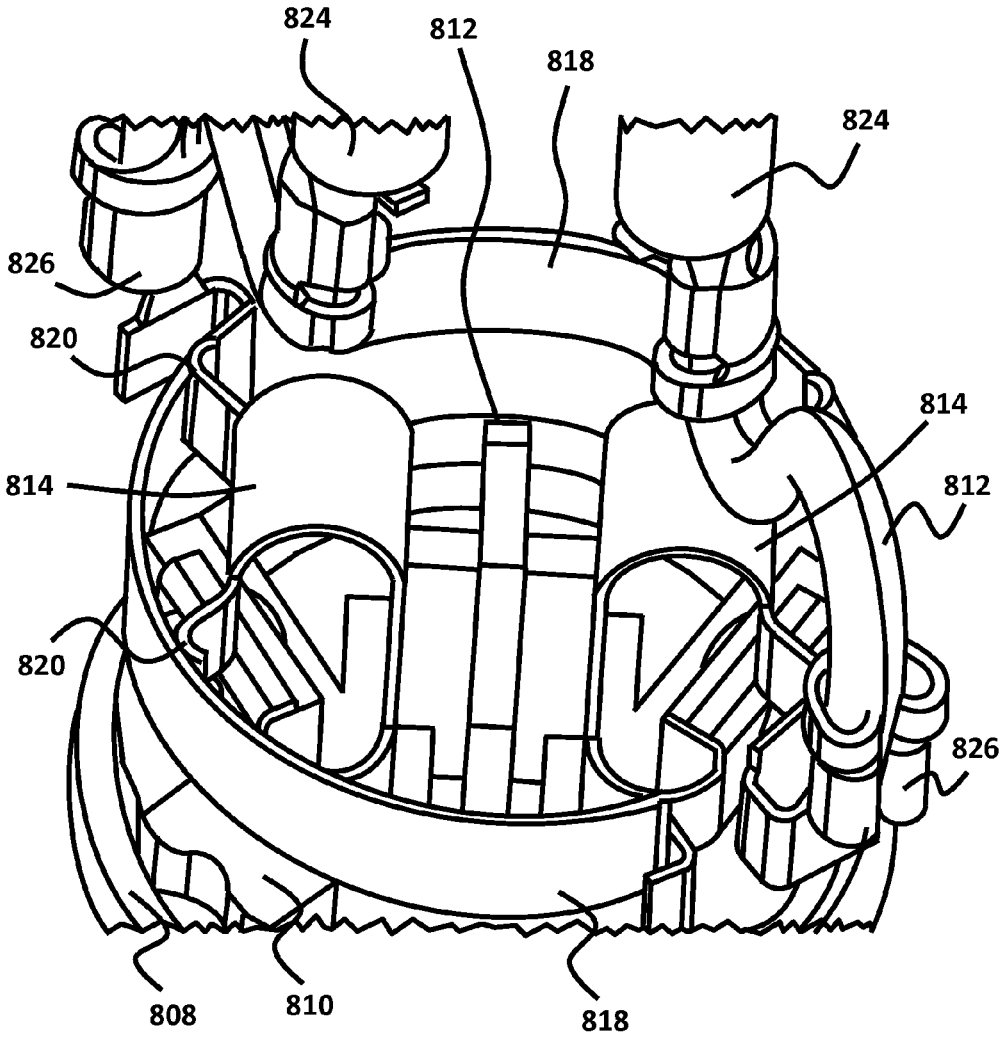
FIG. 9 illustrates a perspective view of the spring contacts and the half-ring contacts from FIG. 8.
Figure 10:
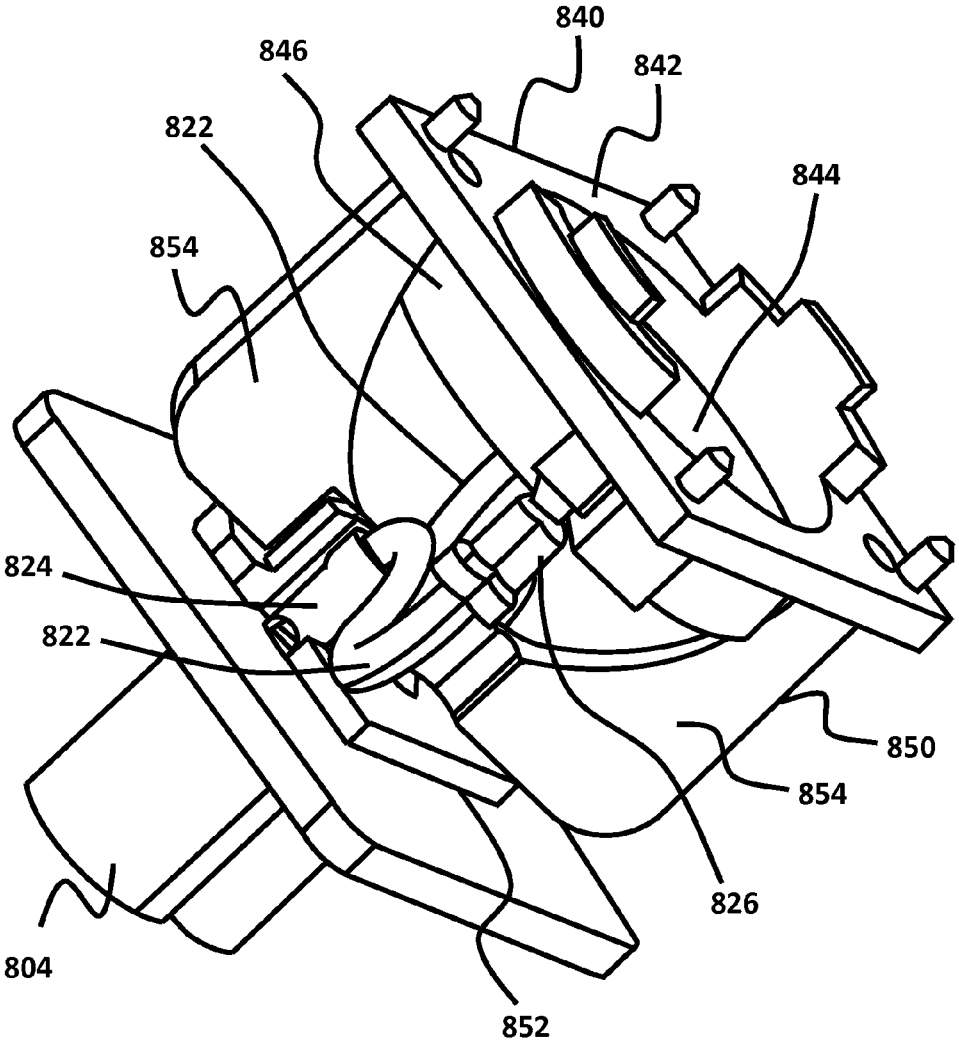
FIG. 10 illustrates a partial assembly of the duck head connector from FIG. 8, including an inner housing used to structurally support the duck head housing.

The duck head connector as disclosed herein can use plugs of any voltage standard and plugs supporting two or more voltage standards. The duck head connector can also use plugs of any shape, size, and type. For example, FIGS. 1-7 illustrate a duck head connector 100 with a Europlug 104. As noted, alternative embodiments can be used with plugs of type A through type M. Common plug types include type A plugs used in North America, type I plugs used in Australia and China, and type D plugs used in the UK, among others. FIGS. 8-10 illustrate an alternative embodiment of a duck head connector 800 for an Australian plug 802.

Embodiments of the duck head connector can also use polarized plugs, unpolarized plugs, grounded, and ungrounded plugs. Connector 100 is an example of an unpolarized and ungrounded plug. Grounded plugs include a third grounding pin or prong typically extending further than the live prong and the neutral prong to ensure that it is engaged first and that the device is grounded prior to the connections by the live and the neutral prongs.

Figure 2A:
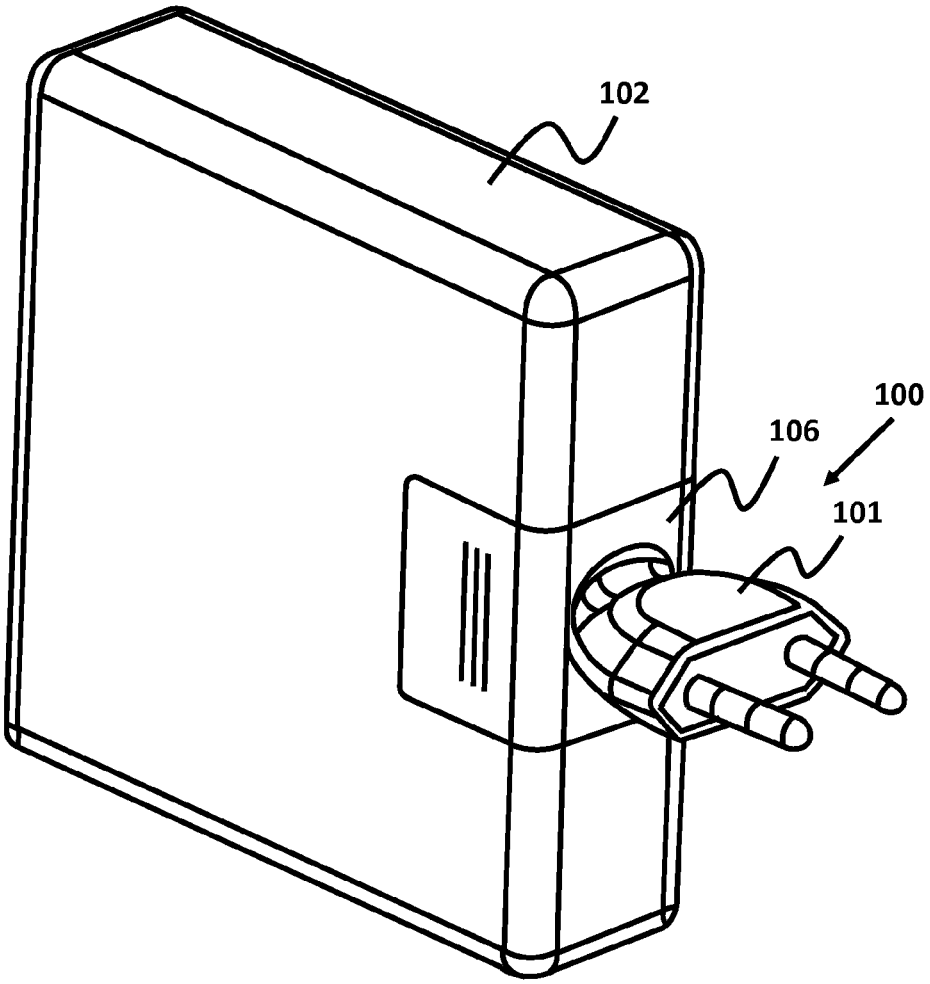
FIGS. 2A and 2B illustrate the duck head connector from FIG. 1 connected with a rectangular power adapter, with the plug of the duck head connector oriented horizontally and the plug oriented vertically after having been rotated 90 degrees.
Figure 2B:
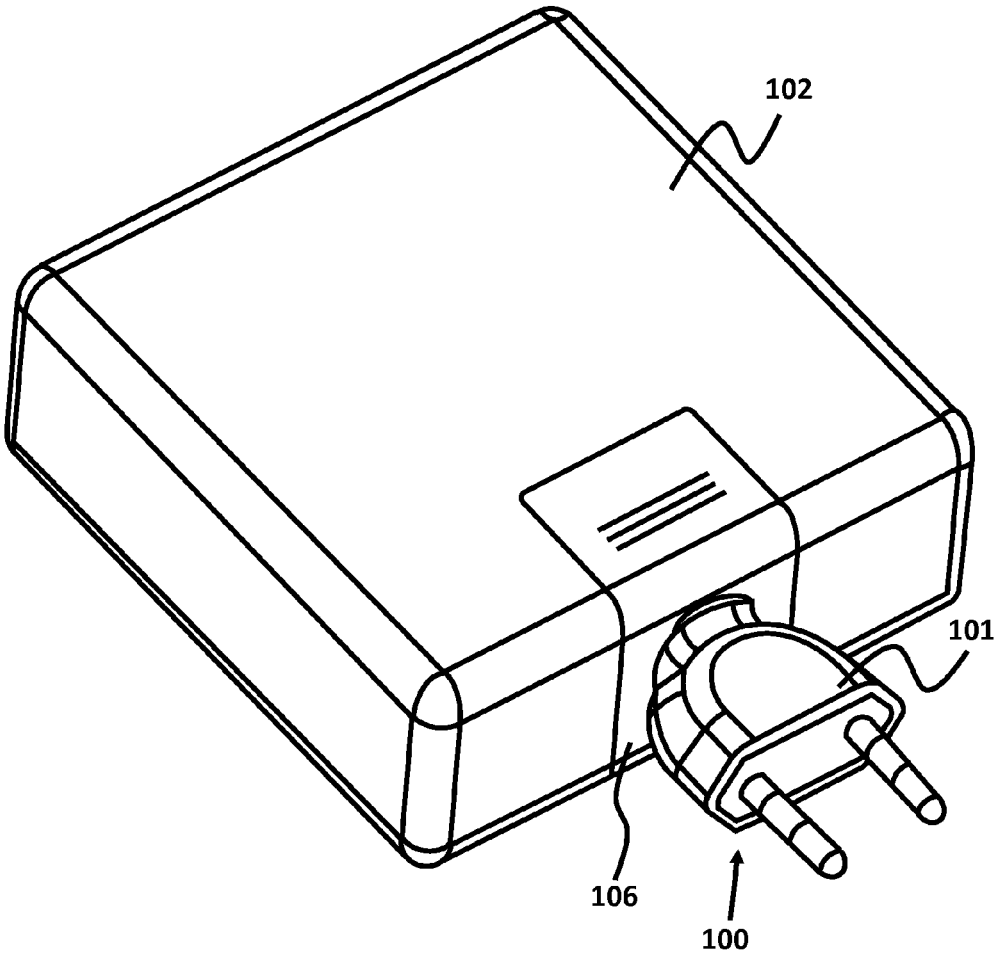

Plug 101 is comprised of prongs 120 and a plug housing 104. The plug housing 104 is attached to duck head housing 106, a substantially rectangular box. Duck head housing 106 houses the assembly that connects the prongs 120 to the contacts of C7 connector 108. Part of this connection assembly may also be housed within plug housing 104. The connector 108 is attached to a first side of the duck head housing 106, with the plug 101 attached to a second side of the duck head housing 106. In the connector 100, the plug 101 is positioned on the second side that is substantially opposite the first side including the C7 connector 108. The plug 101 rotates about the face formed by the second side of the duck head housing 106 as illustrated in FIGS. 2A and 2B.

However, the housing 106 need not be substantially rectangular box shaped, with other shapes for the housing such as cylinders being possible. It is also not necessary for the connector 108 to be on an opposite side of the housing 106 from the plug 101. In particular, embodiments of the duck head connector, and specifically the housing of the duck head connector, can have any shape as long as (1) the electric plug is able to rotate about the side of the plug, and (2) the flexible insulated wires can freely rotate within the housing of the duck head connector. The duck head connector 100 can use a separate plug housing 104 and a duck head housing 106, as illustrated in FIG. 1. Alternatively, the duck head connector can use a single housing for both the plug 101 and the C7 connector 108, with the plug 101 and the C7 connector 108 preferably positioned on opposite sides or faces of the single housing.

Positioning the electric plug on the side of the housing directly opposite the side of the C7 connector allows the number of bends in the flexible insulated wires to be minimized. If the electric plug and the C7 connector are positioned on sides of the housing directly opposite of each other, the flexible insulated wires can be oriented substantially along a single linear axis. In contrast, if the electric plug and the C7 connector are positioned on adjacent sides of a substantially rectangular housing, then the flexible insulated wires would have to be bent substantially at a 90 degree angle to enable the wires to travel from the prongs of the plug to the contacts of the C7 connector.

The use of a duck head housing for the C7 connector and a plug housing for the electric plug, rather than using a single housing for both the plug and the C7 connector, can be based on the type of electric plug used, the number and arrangement of the prongs in the plug, whether the duck head connector is meant to be used with a plurality of devices with C8 inlets, or whether the duck head connector is meant to be used with a specific device. The duck head connector 100 from FIG. 1 makes use of a substantially rectangular duck head housing 106 that fits into the substantially rectangular slot 110 in adapter 102. However, the duck head connector 100 may also consisted of a single housing having a longer length for fitting the entire connection assembly, the C7 connector, and the electric plug. As indicated above, the housing need not be rectangular shaped, it can also be curve shaped, such as plug housing 104, or it can be irregularly shaped.

For a duck head connector having a plug without a ground pin, it may suffice to use a single housing for the electric plug and the C7 connector. Alternatively, for a duck head connector having a plug with a ground pin, or having larger prongs spaced farther apart, it may be necessary to use both a duck head housing and a plug housing. Finally, if the arrangement of the prongs, due to the type of plug being used, results in a single housing of inadequate shape and dimensions given the connector requirements, it may then be beneficial to have a plug housing with an irregular shape and a duck head housing with a smaller profile.

As indicated above, the plug 101 of the duck head connector 100 swivels to allow connection of the plug 101 with an electric socket at a preferred orientation. For example, a first orientation may be preferable when the plug 101 is being connected to a wall socket, while a second orientation may be preferable when the plug 101 is being connected to an electric socket on a crowded surge protector.

FIGS. 2A and 2B illustrate two possible orientations of the plug 101. In FIG. 2A the plug 101 is oriented vertically, and in FIG. 2B the plug 101 is oriented horizontally after having been rotated 90 degrees. The plug 101 rotates about the side of the duck head housing 106, with the duck head housing 106 remaining stationary. In an embodiment, the plug 101 rotates 90 degrees between a horizontal position and a vertical position, with the horizontal and vertical positions including locking features (described below in detail) that prevent the plug 101 from being rotated beyond a certain point. The duck head connector can also be configured to enable the plug to rotate between a first position and a second position, which may be greater than or less than 90 degrees. For instance, the first position may be 10 degrees, while the second position may be 120 degrees. It is also noted that the plug 101 need not be at the first position or the second position to function, as the range of rotation of plug 101 enables the plug 101 to rotate and be used at any position between the first position and the second position without loss of electrical connection. The structure used to limit rotation of the plug 101 will be further described below.

Figure 3:
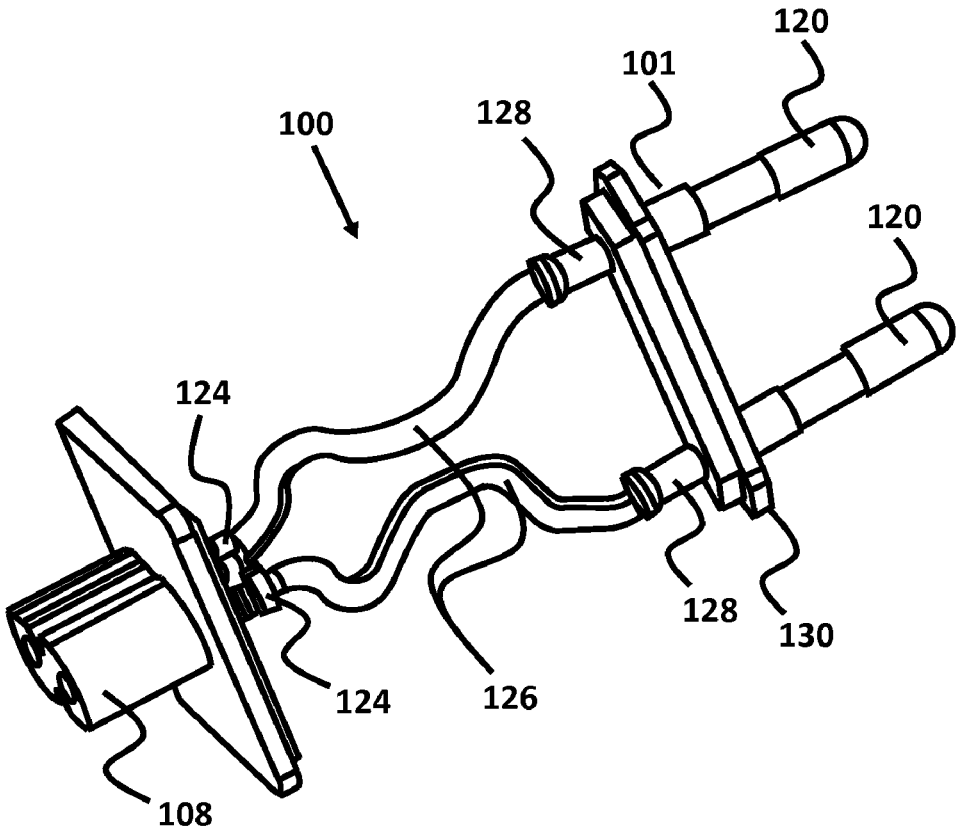
FIG. 3 illustrates a partial assembly of the duck head connector from FIG. 1, with flexible insulated wires connecting the prongs of the electric plug to the C7 contacts.

FIG. 3 illustrates a partial assembly of the duck head connector 100, illustrating the duck head connector 100 without the plug housing 104 and without the duck head housing 106. The prongs 120 of plug 101 are arranged such that a bottom portion 128 of prongs 120 project from the bottom of plug base 130. One end of the of the ends of the flexible insulated wires 126 is permanently fixed to the bottom portion 128 of prongs 120, and the opposite end of the flexible insulated wires 126 is connected to the C7 contacts 124.

Flexible insulated wires 126 have a substantially meandering shape. In particular, the flexible insulated wires 126 are bent and shaped such that when flexible insulated wires rotate with the plug 101, each of the flexible insulated wires 126 has the freedom to wrap around the other flexible insulated wire 126 without becoming tangled and without imposing stress on the other wire. It is to be understood that the flexible insulated wires 126 need not be bent or formed into the shape illustrated in FIG. 3. What is important is for the flexible insulated wires 126 to rotate freely and without obstructing each other as the wires rotate with the plug 101. As further described below, limiting the rotation of the plug 101 to a specific range helps limit the extent to which the flexible insulated wires 126 wrap around each other during rotation of the plug 101. The flexible insulated wires 126 can also be shorter or longer than illustrated in FIG. 3, or they can be shaped to have a single bend or curve, rather than having two curves as illustrated in FIG. 3.

The use of the flexible insulated wires 126, in contrast to using metal stamping parts, provides greater flexibility for ease of inserting the C7 contacts into the housing of the C7 connector after crimping between the C7 contacts and the wires 126. This ensures that the C7 contacts can be seated to the appropriate depth and the desired orientation within the C7 connector. When using metal stamping parts and a solder joint process, any deformation has the potential of affecting the precise seating of the C7 contacts, making the assembly process more difficult.

Figure 4:
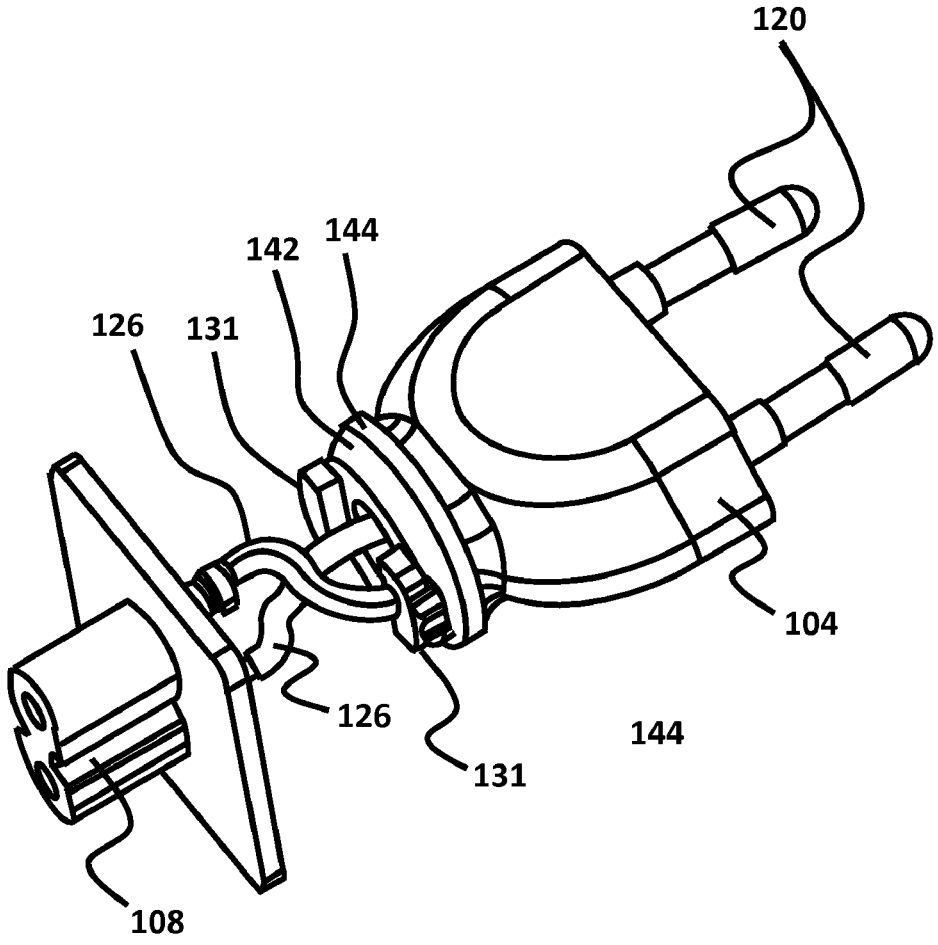
FIG. 4 illustrates the partial assembly from FIG. 3, but further including an assembled plug housing.

FIG. 4 illustrates the partial assembly from FIG. 3, and also includes the assembled plug housing 104. Plug housing 104 includes a pair of latches 131 that help secure the plug housing 104 to the duck head housing 106. The latches 131 also engage a latching plate or an alternative fastening mechanism, further described below, to secure the plug 101 at one or more positions after it has been rotated.

Figure 5:
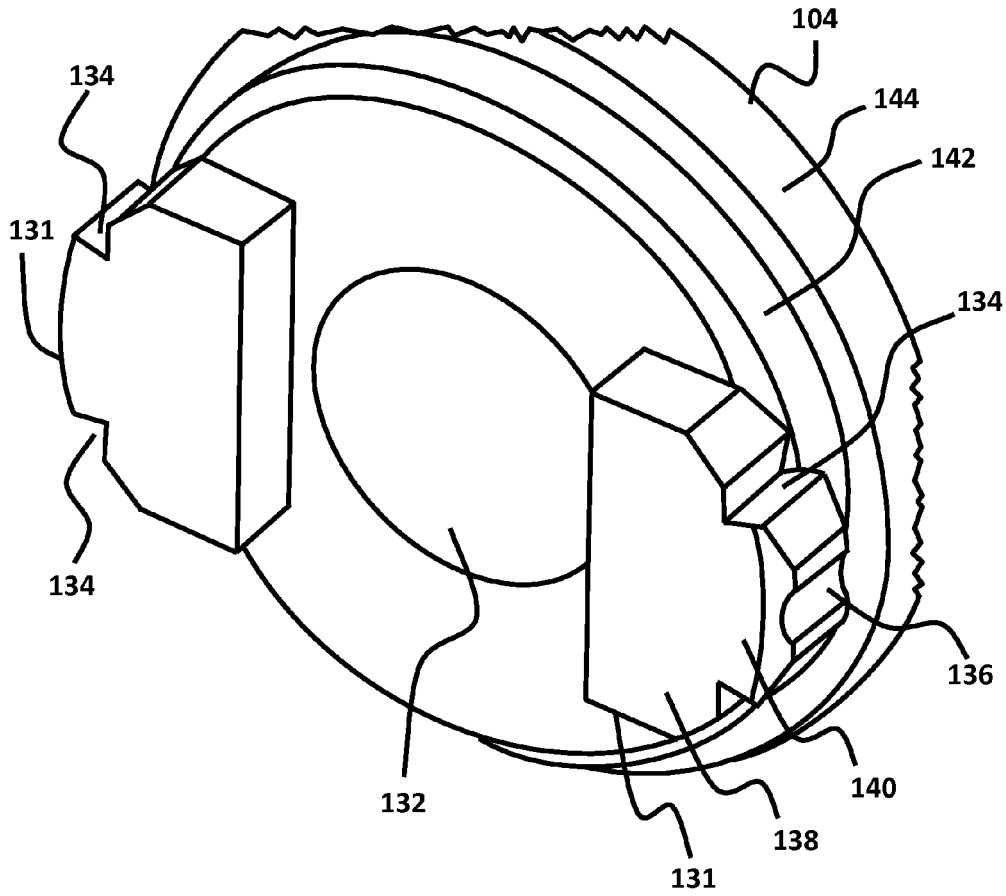
FIG. 5 illustrates a partially broken view of the bottom of the plug housing in accordance with an embodiment.

FIG. 5 further illustrates the partially broken view of the bottom of the plug housing 104 from FIG. 4. Plug housing 104 includes an opening 132 through which the flexible insulated wires 126 fit and pass through for connecting the plug 101 to the C7 connector 108. The opening 132 is large enough to enable the flexible insulated wires 126 to rotate freely without obstructing each other or overly rubbing against the plug housing 104. The latches 131 include a side notch 134 formed on each side of the latches 131, and a dimple or depression 136 formed on the top portion of the latches 131. The side notch 134 and the depression 136 engage with features of a latching plate, further described below, to limit rotation of the plug within a specific range.

Figure 6:
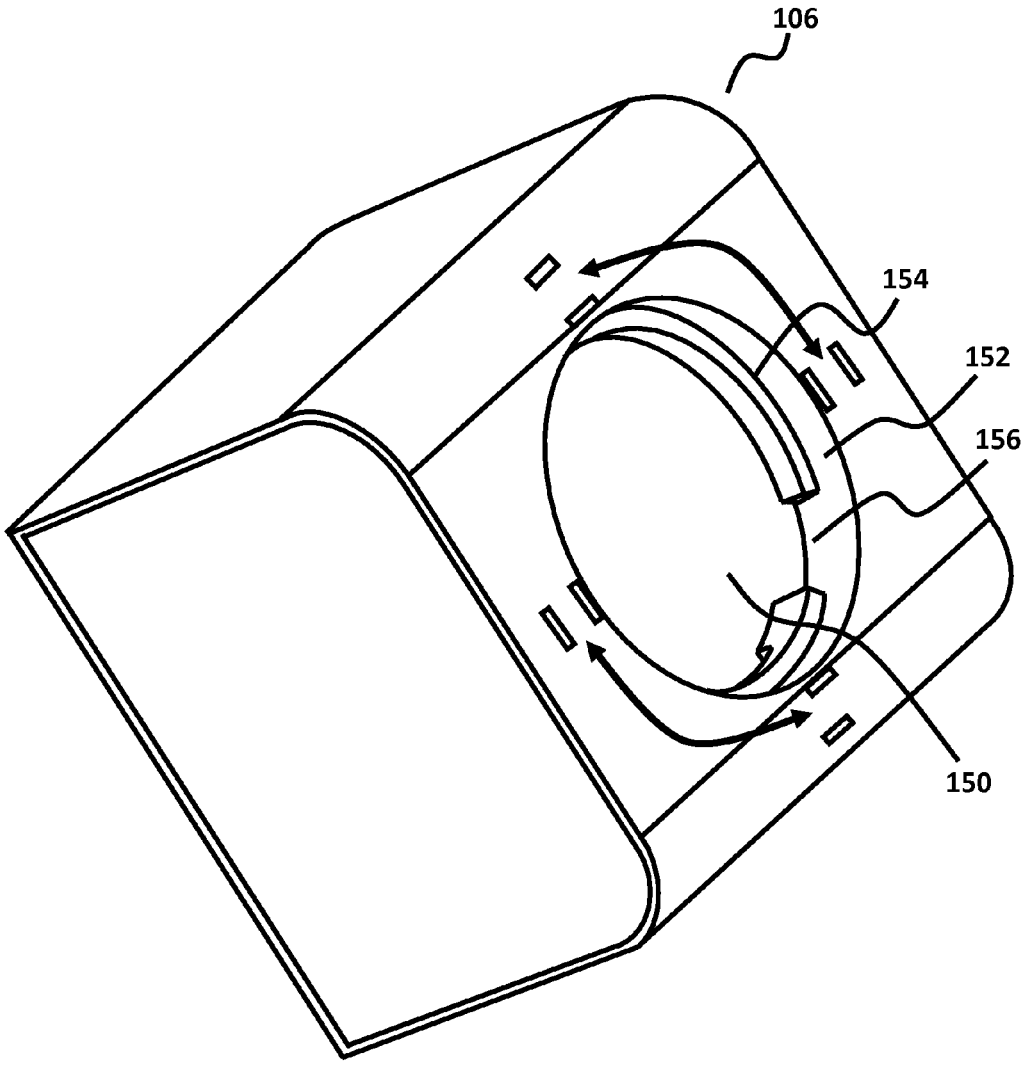
FIG. 6 illustrates an embodiment of a duck head housing.

The latches 131 are comprised of a substantially rectangular lower portion 138 and a substantially crown-shaped upper portion 140. The upper portion 140 can also be described as being a substantially inverted trapezoid shape. The upper portion 140 extends beyond the lip 142 of the plug housing 104. Adjacent to the lip 142 is a substantially raised lip area 144 formed along the circumference of lip 142. The bottom portion of the plug housing 104 is thus comprised of a valley (or indented area) consisting of lip 142, with the lip 142 sandwiched between the latches 131 and the raised lip area 144. The lip 142 engages a circular rib 154 formed on a corresponding opening of the duck head housing 106, as illustrated in FIG. 6.

The latches 131 need not be identical to the shapes illustrated in FIGS. 4 and 5. For example, the latches 131 can be substantially rectangular shaped, or may alternatively be comprised of only the lower portion 138, or comprised of only the upper portion 140. Regardless of the shape used for the latches 131, it is important for the features of the latches 131 to engage the corresponding features of the latch plate (illustrated in FIG. 7C), or the alternative fastening mechanism, to limit rotation of the plug to a predetermined range.

The side notch 134 of the latches 131 is substantially V-shaped, but alternative embodiments can have differently shaped notches or a different number of notches. For instance, the side notch 134 can be L-shaped, U-shaped, zigzag shaped, etc. The latches 131 may also have a side notch 134 on only one side of the latches 131, rather than having a side notch 134 on both sides of the latches 131. Finally, in embodiments the latches 131 can have more than one side notch 134 on the sides of the latches 131.

The latches 131 can also vary by the shape and size of the depression 136. The depression 136 can be substantially U-shaped, V-shaped, rectangular shaped, etc. It is also possible for the top portion of the latches 131 to not include a depression 136. In such an embodiment, the top portion of the latches 131 would be flat or may alternatively have a slanted top, and the sides of the latches would serve the function of engaging the corresponding features of the latching plate. Alternatively, the top portion of the latches 131 can have two or more depressions 136 engaging with corresponding features of the latch plate.

The latches 131 in the plug housing 104 need not be identical. That is, a first latch can have a first shape, and a second latch can have a second shape. For instance, a first latch 131 can be shaped to have at least two side notches 134 formed on the sides of the first latch 131, while a second latch 131 can be shaped to have a single side notch 134 on each side of the second latch 131. Alternatively, the first latch 131 can have a depression 136 but not have a side notch 134, and the second latch 131 can have a side notch 134 but not have a depression 136.

FIG. 6 illustrates an embodiment of an assembled duck head housing 106. The duck head housing 106 is substantially rectangular shaped, but as indicated above, the duck head housing 106 can be shaped in various ways without departing from the spirit of the invention. The duck head housing 106 forms an opening 150 whose size is substantially equivalent and fits the bottom section (illustrated in FIG. 5) of the plug housing 104. The inner surface 152 of the opening 150 includes a circular rib 154 with two gaps 156 (only one of the gaps is illustrated in FIG. 6). Lining the latches 131 of the plug housing 104 with the gaps 156 enables the bottom of the plug housing 104 to be partially inserted into the duck head housing 106. When the plug housing 104 is inserted into the opening 150 of the duck head housing 106 and rotated, the lip 142 engages the circular rib 154 and locks to prevent the plug housing 104 from moving and separating from the duck head housing 106.

In one embodiment, the plug housing 104 is inserted into the duck head housing opening 150 until the circular rib 154 abuts against the raised lip surface 144 of the plug housing 104. The duck head housing 106 has a gap 156 for each latch 131 of the plug housing 104. The gaps 156 can be substantially larger than the latches 131 to enable the same duck head housing 106 to be used with plug housings 104 having latches 131 of various sizes.

As noted above, once the plug housing 104 has been inserted into the duck head housing 106, the plug housing 104 is rotated until the plug housing 104 locks with the duck head housing 106. This prevents the plug housing 104 from moving during use and separating from the duck head housing 106. As the plug housing 104 is rotated, the circular rib 154 slides along the lip 142 of the plug housing 104, the latches 131 slide along the bottom surface of the circular rib 154, and the raised lip surface 144 slides along the top surface of the circular rib 154. The circular rib 154 prevents the plug housing 104 from being pulled away from the duck head housing 106 because the circular rib 154 is sandwiched between the latches 131 and the raised lip surface 144.

Figure 7A:
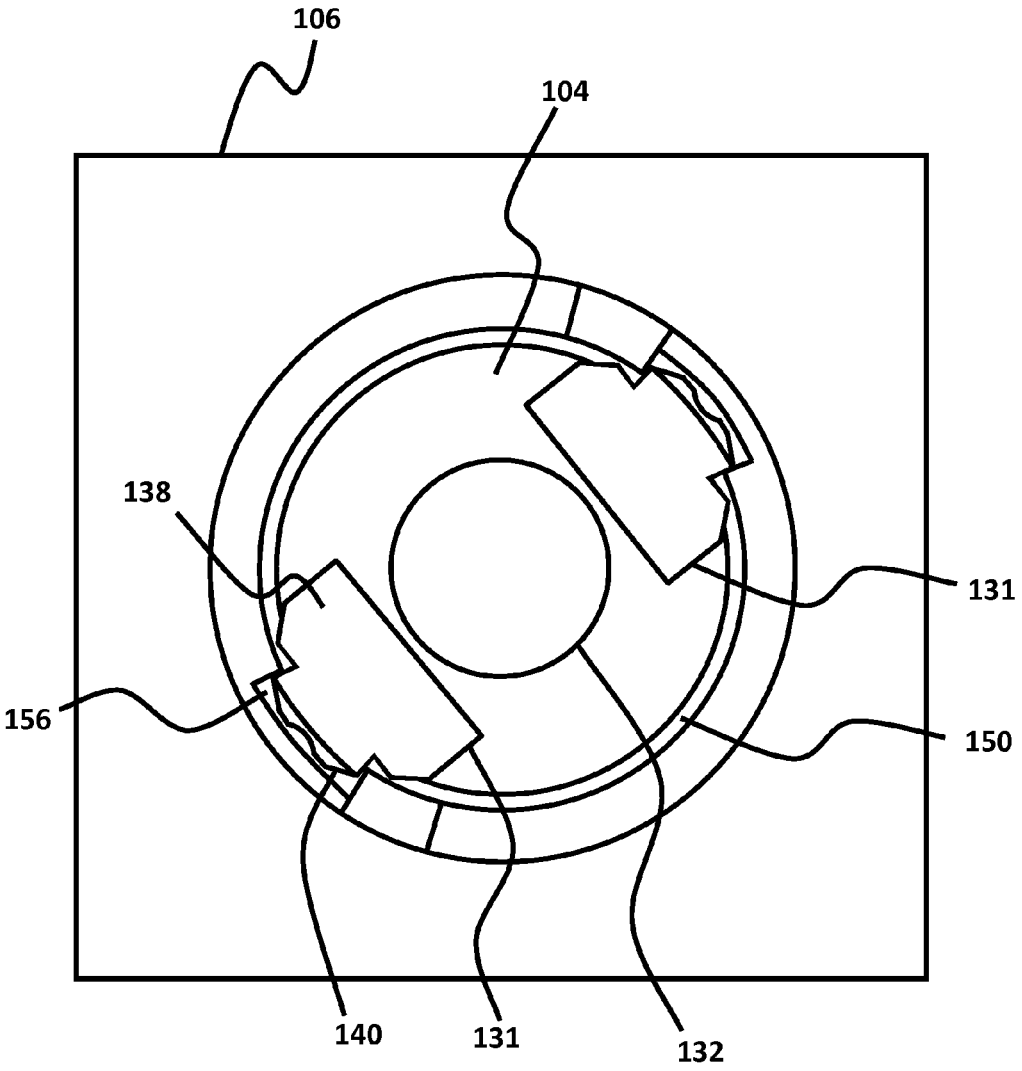
FIGS. 7A-7D illustrate cross-sectional views, from a bottom perspective, of the plug housing locked with the duck head housing and of the latch plate used to restrict rotation of the plug.
Figure 7B:
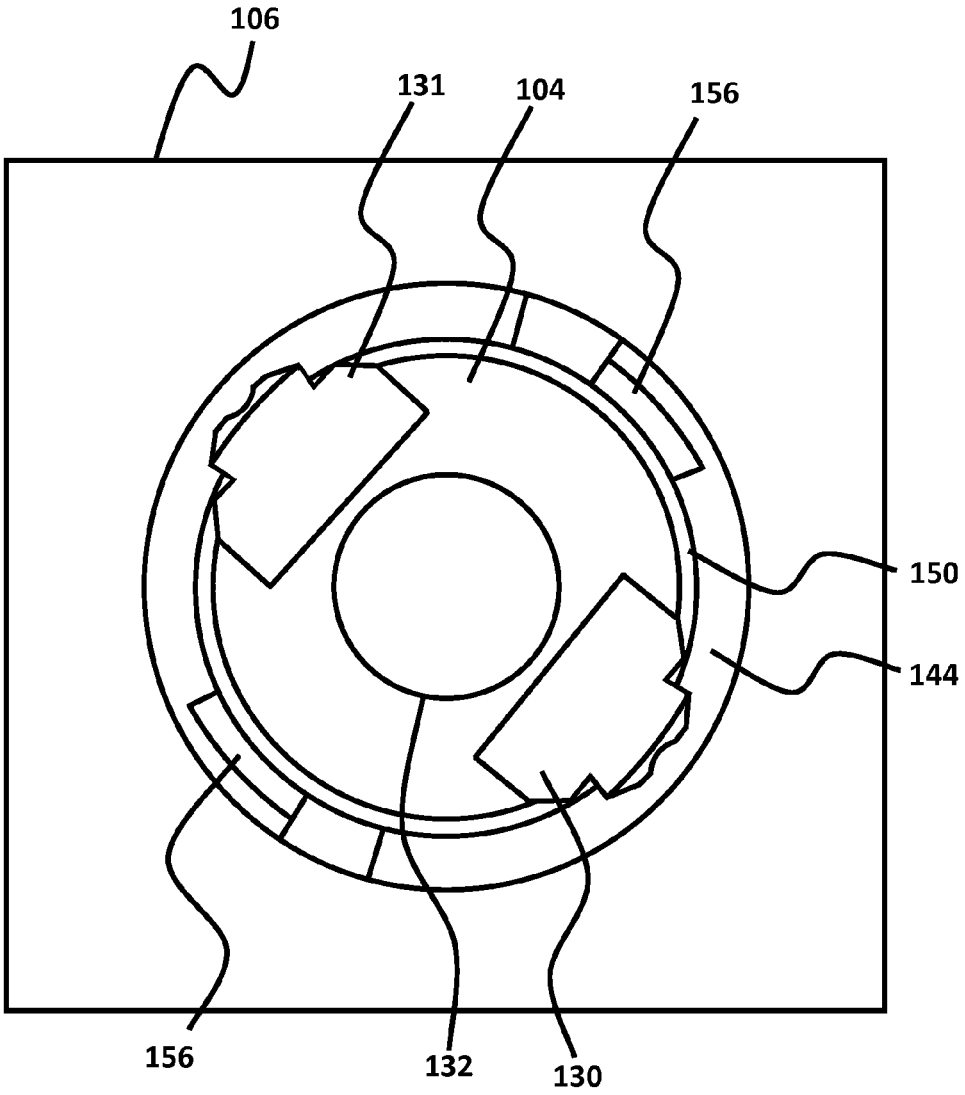
Figure 7C:
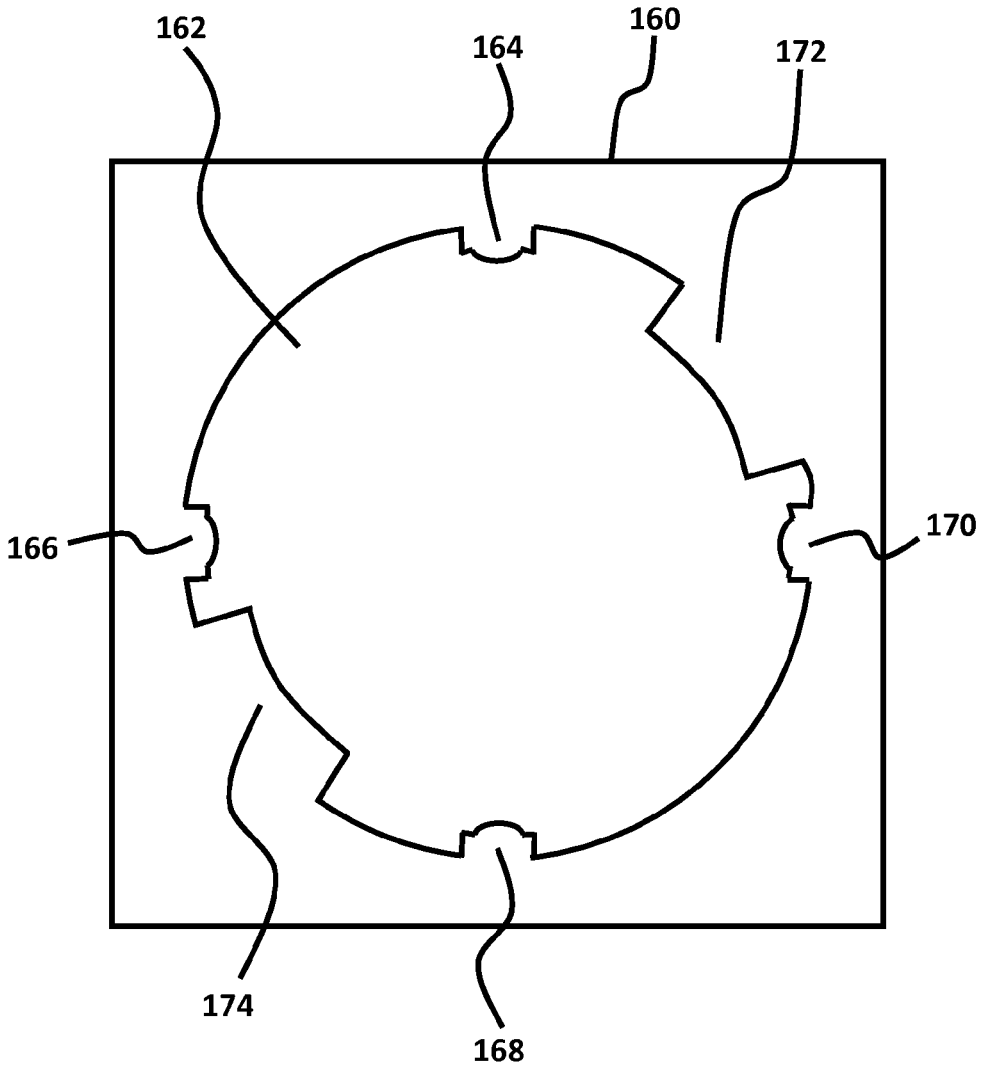
Figure 7D:
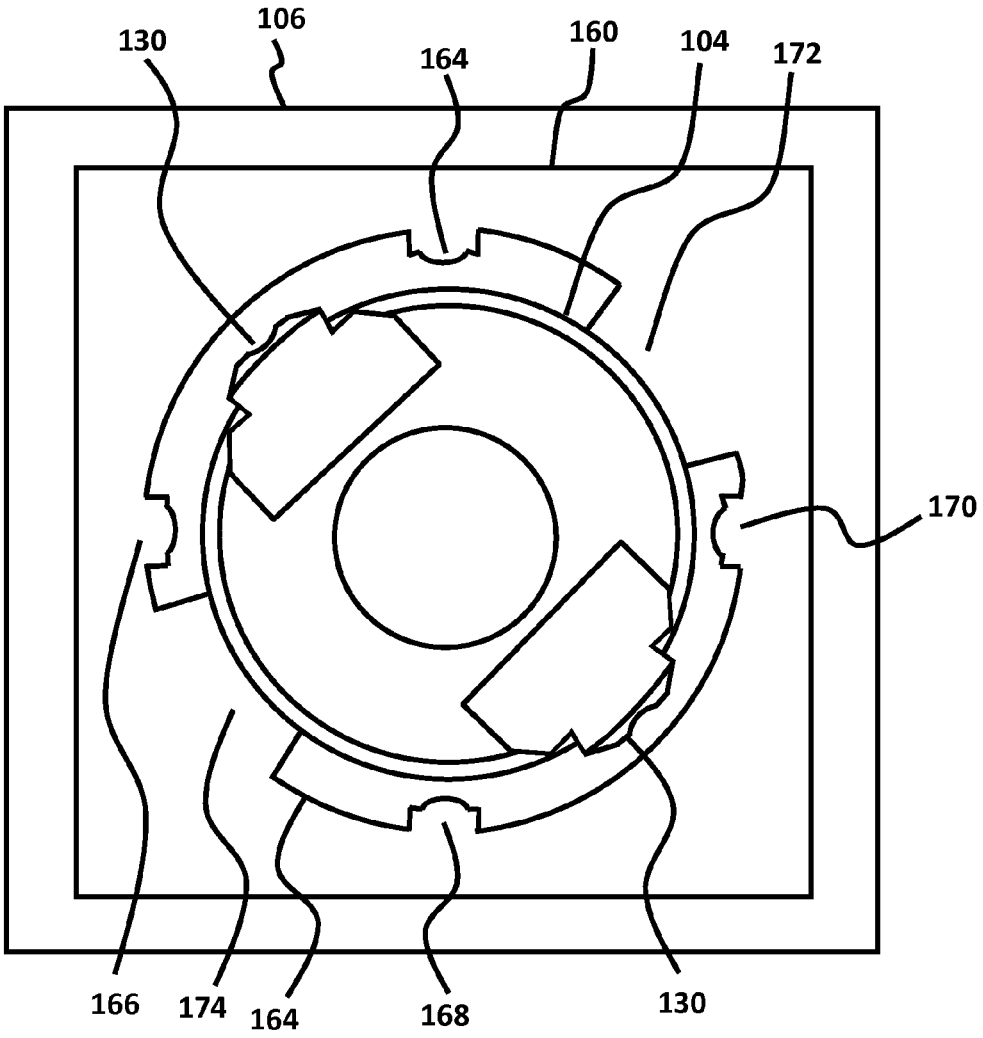

FIGS. 7A, 7B, and 7D illustrate a bottom, cross-sectional view of the plug housing 104 locking with the duck head housing 106. In FIG. 7A, the plug housing 104 has been initially inserted into the duck head housing 106 through the opening 150 of the duck head housing 106, with the latches 131 aligned with the gaps 156 of the circular rib 154. The gaps 156 are large enough to enable the crown-shaped upper portion 140 of the latches 131 to fit through the opening 150 and the circular rib 154. While FIG. 7A shows a tight fit between gaps 156 and the upper portion 140 of the latches 131, alternative embodiments can have wider or longer gaps 156. It is also to be understood that the shape and size of the gaps 156 will be dependent on the shape and size of the latches 131.

FIG. 7A shows the upper portion 140 of the latches 131 fitting through gaps 156, but in alternative embodiments the plug housing 104 or the duck head housing 106 can be manufactured to have at least a portion of the bottom portion 138 of the latches 131 fit through the gaps 156. For instance, in FIG. 7A the base of the latch 131 is positioned close to the opening 132 of the plug housing 104. However, in alternative embodiments the latches 131 can be positioned farther from the center of the opening 132 of the plug housing 104, resulting in the latches 131 extending further beyond the lip 142 (shown in FIG. 5) of the plug housing 104.

The elements of the plug housing 104 and the duck head housing 106 can be arranged in alternative ways without departing from the spirit of the invention, and will be apparent to one skilled in the art. For example, embodiments of the circular rib 154 are positioned such that the bottom of the circular rib 154 is aligned with the inner lip of the opening 150 of the duck head housing 106. Alternatively, the circular rib 154 can be positioned in the middle of the inner surface 152 of the duck head housing 106. In the present example, regardless of the position and sizing of the circular rib 154, it is important for the lip 142 and latches 131 to engage the circular rib 154 in a snug fit to minimize movement after the plug housing 104 has been locked with the duck head housing 106. FIG. 7B illustrates the plug housing 104 rotated about 90 degrees from the positioned illustrated in FIG. 7A, and locked with the circular rib 154 to prevent the plug housing 104 from moving.

FIG. 7C illustrates a cross-sectional view of a latch plate 160. The latch plate 160 is added to the duck connector assembly after the plug housing 104 has been locked with the duck head housing 106. The latch plate 160 is used to limit the range of rotation of the plug housing 104. FIG. 7D illustrates a cross-sectional view of the latch plate 160 assembled with the duck head housing 106 and the plug housing 104.

The latch plate 160 is substantially rectangular shaped. The length and width of the latch plate 160 are smaller than the length and width of the duck head housing 106 to enable the latch plate 160 to fit within the duck head housing 106. Latch plate 160 forms an opening 162 (illustrated in FIG. 7C) with a circumference greater than the lip of the plug housing 104. The latch plate 160 includes a top latching feature 164, a left latching feature 166, a bottom latching feature 168, and a right latching feature 170. These latching features are formed along the circumference and project into the opening 162 of the latch plate 160. The latching features have complimentary features that engage and lock with the latches 131. In particular, the latching features include a rounded top that engages the indentation 136 of the latches 131. The latch plate 160 also includes a first stopper 172 and a second stopper 174 consisting of a raised plateau with a substantially curved top projecting into the opening 162. While the stoppers are illustrated having a substantially curved top, alternative embodiments can have differently sized and shaped stoppers.

The stoppers in combination with the latching features prevent the plug from being over rotated, thus ensuring that the latching features on the latch plate engage the latches 131. In particular, the sides of the stoppers engage the side notches 134 of the latches 131. However, it is noted that the stoppers 166 can be shaped differently in order to engage the side notches 134 or other portions of the latches 131 in a different way. For instance, if the latches 131 are substantially rectangular shaped, then the sides of the stoppers can engage all or a portion of the sides of the latches 131.

In an alternative embodiment, arranging the stoppers at various positions helps tune the degree of rotation of the plug housing. For example, the first stopper 172 can be reduced by half in size and the right latching feature 170 can be moved up and closer to the first stopper 172. Similarly, the second stopper 174 can be reduced by half in size and the left latching feature 166 moved down and closer to the second stopper 174. These modifications would increase the rotation of the plug housing between the two orientations to greater than 90 degrees.

The number of latching features and their arrangement around the circumference of opening 162 depends on the number of latches 131 used in the plug housing 104, the arrangement of the latches 131, and the desired range of rotation for the plug housing 104. Latch plate 160 uses four latching features to enable the plug housing 104 to rotate and lock at two orientations. In a first orientation, the first latch engages the top latching feature 164 and the second latch engages the bottom latching feature 168. In a second orientation, at a 90 degree angle rotation from the first orientation, the first latch engages the left latching feature 166 and the second latch engages the right latching feature 170.

In the latch plate 160, the top latching feature 164 and the bottom latching feature 168 form a first set of latching features that engages the latches 131 at a first orientation, while the left latching feature 166 and the right latching feature 170 form a second set of latching features that engages the latches 131 at a second orientation. However, as indicated above, the latch plate 160 can include more than two set of latching features to enable the plug housing to lock at more than two orientations. It is also noted that the plug housing is allowed to freely rotate between sets of latching features. The use of the latching features enables the plug housing 104 to remain fixed at a particular orientation, but it is also possible for the plug housing 104 to be rotated and used without the plug housing being locked at a particular orientation.

The position of the latching features in a set of latching features is dependent on the arrangement of the latches in the plug housing. In the plug housing 104, the latches 131 are positioned 180 degrees from each other. Consequently, the latching features of the first set of latching features are positioned 180 degrees from each other, and the latching features of the second set of latching features are positioned 180 degrees from each other. However, if the latches 131 on the plug housing 104 were positioned 45 degrees from each other, then the latching features of the first set of latching features and the second set of latching features would be arranged at 45 degrees from each other. It is to be understood that the number of latches and the number of latching features does not have to be the same. For example, an alternative embodiment can include three or more sets of latches 131, enabling the plug to be locked at various rotation intervals, rather than simply locking between two different positions 90 degrees from each other. Similarly, an embodiment of the plug housing can include a single latch 131, with the latch plate 160 including a plurality of latching features enabling the plug to be rotated and locked at small discrete intervals.

The duck head housing 106 assembly can further comprise an inner support to secure the C7 contacts from moving and to support the latch plate 160 in place. The inner support can consist of a columnar brace spanning from the C7 connector 108 to the latch plate 160. FIG. 10 shows an example of a substantially U-shaped columnar support 850 with a base securing the C7 contacts, and with the legs serving as columns that support the latch plate and the plug.

FIG. 8 illustrates a partial assembly of an alternative embodiment of a duck head connector 800. The duck head connector 800 uses a combination of rotary spring contacts that swivel with rotation of the plug, and stationary half-ring contacts with flexible insulated wires connecting the half-ring contacts to the C7 connector. The connector 800 includes a plug 802 and a C7 connector 804. The plug 802 includes prongs 806, with the type of prongs used and the number and arrangement of the prongs depending on the type of the plug 802. In particular, the plug 802 is an Australian SAA plug.

Duck head connector 800 is an example of a connector that uses a plug 802 without a plug housing, with the plug 802 being comprised of only a plug base 808 and prongs 806. The plug base 808 includes two latches 810 (only one is shown) formed along the lip of the bottom portion of the plug base 808. In addition, the bottom of the plug base 808 includes an insulation wall 812 providing insulation between the bottom portion of the prongs 806 and between the spring contacts 814.

The plug base 808 has two openings that fit a bottom portion of the prongs 806. The openings on the plug base 808 are shaped and sized accordingly to provide a snug fit when the bottom portion of the prongs 806 is inserted into these openings. Alternatively, the plug base 808 can include a stopper allowing only a portion of the prongs 806 to slide into the plug base 808.

The prongs 806 can be secured to the plug base 808 using a plurality of fastening devices. In connector 800, spring contacts 814 are fastened to the bottom portion of the prongs 806 with a rivet 816, securing both the spring contacts 814 in place and securing the prongs 806 to the plug base 808. However, alternative methods of fastening the prongs 806 to the plug base 808, and of fastening and securing the spring contacts 814 to the prongs 806, can be used without departing from the spirit of the invention. Alternative fastening devices include bolts, screws, pins, studs, clamps, etc. Alternative fastening methods include crimping, soldering, gluing, etc.

The plug base 808 is assembled by attaching the prongs 806 to the plug base 808 and by fastening the spring contacts 814 to the prongs 806. After the plug base 808 is assembled, the plug base 808 is assembled with the single housing by inserting the plug base 808 into an opening of the single housing as illustrated in FIG. 7. In FIG. 7, the bottom portion of the plug housing 104 is inserted into the opening of the duck head housing 106 and rotated to lock the plug housing 104 with the duck head housing 106. In the present embodiment, it is the plug base 808 that is inserted into the single housing by aligning the latches 810 of the plug base 808 with the corresponding gaps in the opening of the single housing, and rotating the plug base 808 to lock with the single housing. Finally, as indicated above, the latches 810 engage a corresponding set of latching features formed on a latching plate on the single housing. In alternative embodiments, the latching features can be formed along the inner lip of the single housing. Hence, rather than including a separate latch plate, the single housing can be manufactured to include latching features and/or stoppers that engage the latches 810 of the plug base 808.

The spring contacts 814 rotate with the plug 802 within a range of rotation. During rotation, the spring contacts 814 slide along the inner surface of the half-ring contacts 818, maintaining a connection even as the plug is rotated. The spring contacts 814 can be shaped in various ways. What is important is for the spring contacts 814 to maintain a physical connection with the half-ring contacts 818 as the plug swivels. Specifically, duck head connector 800 is comprised of a live prong, a neutral prong, a first spring contact connected to the live prong and swiveling along the surface area of a first half-ring contact, a second spring contact connected to the neutral prong and swiveling along the surface area of a second half-ring contact, a first flexible insulated wire connecting the first half-ring contact to a first C7 contact, and a second flexible insulated wire connecting the second half-ring contact to a second C7 contact.

FIG. 9 illustrates the bottom portion of the plug base 808. The spring contacts 814 include two wings 820 which are bent away from the spring contacts 814 to make and maintain contact with the half-ring contacts 818. In an alternative embodiment, the spring contacts 814 may include only a single wing 820. However, the use of the two wings 820 ensures that an electrical connection is maintained regardless of the rotation of the spring contacts 814. Alternatively, the spring contacts 814 can be shaped to contact the half-ring contacts 818 without the use of the wings 820. Regardless of the shape of the spring contacts 814, it is preferable for the point of contact of the spring contacts 814 that slides along the surface of the half-ring contacts 818 be substantially smooth curve shaped, thus maximizing the contact surface between the spring contacts 814 and the half-ring contacts 818.

It is also important for the spring contacts 814 be shaped and oriented such that the distance between the spring contacts 814 and the half-ring contacts 818 remains the same when the plug and the spring contacts 814 rotate. Thus, the spring contacts 814 are preferably oriented and positioned such that the contact surface of the spring contacts 814 remains equidistant from the half-ring contacts 818 during rotation of the plug.

The half-ring contacts 818 are substantially arc shaped, forming a substantial half circle shape. The surface area of the half ring contacts 818 needs to be large enough to ensure a reliable physical connection with the spring contacts 814. The half-ring contacts 818 remain stationary as the plug 802 and the spring contacts 814 rotate. Stationary flexible insulated wires 822 connect the half-ring contacts 818 with the C7 contacts 824. The flexible insulated wires 822 connect to one of the ends of each of the half-ring contacts 818 at connection points 826. However, as long as the connection points between the half-ring contacts 818 and the flexible insulated wires 822 does not obstruct the rotation of the spring contacts 814, the connection points can be positioned anywhere along the outer surface of the half-ring contacts 818.

In yet another embodiment, the spring contacts 814 and the half-ring contacts 818 can be arranged such that the half-ring contacts are arranged in the middle between the spring contacts 814, and the spring contacts 814 swivel along the outer surface of the half-ring contacts 818. In this embodiment, the half-ring contacts 818 would be arranged as two half-circles whose open ends face away from each other.

FIG. 10 illustrates a ring contact cover 840 fitting over the half-ring contacts 818, which are hidden behind the circular side wall 846 of the ring contact cover 840. The ring contact cover 840 secures and supports the half-ring contacts 818. The ring contact cover 840 partly consists of a side 842 having an opening 844, which is slightly larger than the diameter formed by the two half-ring contacts 818, and the circular side wall 846 formed along the circumference of the opening 844.

Inner housing 850 provides support between the C7 connector 804 and the ring contact cover 840. The inner housing 850 is comprised of a base 852 and a pair of arms 854 extending from the base 852 to the ring contact cover 840. The arms 854 act as supporting columns between the C7 connector 804 and the ring contact cover 840. The base 852 of the inner housing 850 has an opening that fits around the C7 contacts 824, helping secure the C7 contacts in place and keeping the C7 contacts from moving.

It is to be understood that the inner housing 850 can be shaped in different ways. What is important is for the structure of the inner housing 850 to provide stable support between the C7 connector 804 and the ring contact cover 850. In an alternative embodiment, the inner housing 850 can include more than two arms 854. For instance, the inner housing 850 can include four arms 854, with each of the arms supporting each of the corners of the ring contact cover 840. In yet another embodiment, the inner housing 850 can be substantially bowl shaped, with the top of the inner housing providing equal support around the circumference of the ring contact cover 840.

As noted above, the use of the flexible insulated wires 822, in contrast to using metal stamping parts, provides greater flexibility for ease of inserting the C7 contacts into the housing of the C7 connector after crimping between the C7 contacts and the wires 822. This ensures that the C7 contacts can be seated to the appropriate depth and the desired orientation within the C7 connector. When using metal stamping parts and a solder joint process, any deformation has the potential of affecting the precise seating of the C7 contacts, making the assembly process more difficult.

Yet another embodiment is directed to a duck head connector with a swappable plug. In the embodiment, once the duck head connector has been assembled, the plug can be swapped by rotating the plug until it is unlocked. After the plug has been unlocked, the plug can be removed and replaced with an alternative plug of a different type. In such embodiments, the swappable plugs can be formed to have a plug housing or a plug base with a bottom portion having a standard diameter. This would enable a plurality of plugs to be inserted into the same housing of the duck head connector.

Embodiments of the duck head connector with swappable plugs can be used with the duck head connector embodiments illustrated in FIGS. 8-10. In such an embodiment, the only moving parts are the plug and the spring contacts attached to the prongs of the plug. However, the spring contacts are not permanently attached to the half-ring contacts since the spring contacts need to swivel along the inner surface of the half-ring contacts. Therefore, as long as a plurality of swappable plugs having a base with a standard diameter and the spring contacts are arranged to contact a standard set of half-ring contacts, a plurality of plugs of different types can be used with the same duck head connector. For instance, a first type of plug may require the use of larger spring contacts to enable the spring contacts to maintain a connection with the half-ring contacts. On the other hand, a second type of plug may require the use of smaller spring contacts tilted at an angle to enable the spring contacts to connect with the half-ring contacts. Embodiments of the duck head connector with swappable plugs include a transformer to enable the duck head connector to handle the different voltage standards.

While the present invention has been illustrated and described herein in terms of several alternatives, it is to be understood that the techniques described herein can have a multitude of additional uses and applications. Accordingly, the invention should not be limited to just the particular description and various drawing figures contained in this specification that merely illustrate various embodiments and application of the principles of the invention.

What is claimed is:

1. A duck head connector, comprising:

a housing;

a connector for connection to a power adapter, the connector positioned on a first side of the housing, the connector having a first contact and a second contact;

an electric plug positioned on a rotating face of a second side of the housing, the electric plug including a first prong and a second prong, the electric plug rotating about the second side within a range of rotation;

a first flexible insulated wire housed in the housing, the first flexible insulated wire connecting the first prong with the first contact; and a second flexible insulated wire housed in the housing, the second flexible insulated wire connecting the second prong with the second contact, the first flexible insulated wire and the second insulated wire rotating with the electric plug when the electric plug is rotated while maintaining the connection between the first prong and the first contact and between the second prong and the second contact.

2. The duck head connector as recited in claim 1, wherein the housing is substantially rectangular box shaped and the first side is substantially opposite the second side.

3. The duck head connector as recited in claim 1, wherein the first flexible insulated wire and the second flexible insulated wire have a substantially meandering shape.

4. The duck head connector as recited in claim 1, wherein the electric plug further comprises a bottom portion positioned at an end of the plug opposite the first prong and the second prong, the bottom portion including one or more latches positioned along a circumference of the bottom portion, wherein the housing further comprises one or more locking features formed on the inside of the housing and along the periphery of the second side, the one or more latches engaging the one or more locking features for securing the electric plug to one or more positions within the range of rotation.

5. The duck head connector as recited in claim 4, wherein the housing further comprises one or more stoppers formed on the inside of the housing and along the periphery of the second side, the one or more stoppers restricting rotation of the electric plug to the range of rotation.

6. The duck head connector as recited in claim 1, wherein the electric plug further comprises a grounding prong.

7. The duck head connector as recited in claim 1, wherein the connector is a C7 connector and the electric plug is selected from the group consisting of a Type A, a Type B, a Type C, a Type D, a Type E, a Type F, a Type G, a Type H, a Type I, a Type J, a Type K, a Type L, and a Type M.

8. The duck head connector as recited in claim 1, wherein the electric plug further comprises a bottom portion positioned at an end of the plug opposite the first prong and the second prong, the bottom portion including one or more latches positioned along a circumference of the bottom portion, further comprising a substantially rectangular latch plate positioned inside the housing and adjacent the second side, the latch plate forming a latch plate opening fitting the bottom portion and having one or more locking features formed along the circumference of the latch plate opening, the one or more latches engaging the one or more locking features and securing the electric plug to a position within the range of rotation.

9. The duck head connector as recited in claim 8, further comprising an inner housing positioned on the inside of the housing, the inner housing including a base and two or more arms extending from the first side to the second side, the base securing the first contact and the second contact, and the two or more arms supporting the latch plate.

10. The duck head connector as recited in claim 1, further comprising an inner housing positioned on the inside of the housing, the inner housing including a base and two or more arms extending from the first side to the second side, the base securing the first contact and the second contact, and the two or more arms supporting the electric plug.

11. A duck head connector, comprising:

a housing;

a connector for connection to a power adapter, the connector positioned on a first side of the housing, the connector having a first contact and a second contact;

an electric plug positioned on a rotating face of a second side of the housing, the electric plug including a first prong and a second prong, the electric plug rotating about the second side within a range of rotation;

a first spring contact fastened to the first prong and housed within the housing;

a second spring contact fastened to the second prong and housed within the housing;

a first half-ring contact being substantially curve shaped and housed within the housing, the first spring contact swiveling along an inner surface of the first half-ring contact and maintaining a connection with the first half-ring contact as the electric plug rotates;

a second half-ring contact being substantially curve shaped and housed within the housing, the second spring contact swiveling along an inner surface of the second half-ring contact and maintaining a connection with the second half-ring contact as the electric plug rotates;

a first flexible insulated wire housed in the housing, the first flexible insulated wire connecting the first half-ring contact to the first contact; and a second flexible insulated wire housed in the housing, the second flexible insulated wire connecting the second half-ring contact to the second contact, wherein the first half-ring contact, the second half-ring contact, the first flexible insulated wire, and the second flexible insulated wire remain stationary as the electric plug rotates and as the first spring contact and the second spring contact swivel along the inner surface of the first half-ring contact and the inner surface of the second half-ring contact.

12. The duck head connector as recited in claim 11, wherein the housing is substantially rectangular box shaped and the first side is substantially opposite the second side.

13. The duck head connector as recited in claim 11, wherein the first flexible insulated wire and the second flexible insulated wire have a substantially meandering shape.

14. The duck head connector as recited in claim 11, wherein the electric plug further comprises a bottom portion positioned at an end of the plug opposite the first prong and the second prong, the bottom portion including one or more latches positioned along a circumference of the bottom portion, wherein the housing further comprises one or more locking features formed on the inside of the housing and along the periphery of the second side, the one or more latches engaging the one or more locking features for securing the electric plug to a position within the range of rotation.

15. The duck head connector as recited in claim 14, wherein the housing further comprises one or more stoppers formed on the inside of the housing and along the periphery of the second side, the one or more stoppers restricting rotation of the electric plug to the range of rotation.

16. The duck head connector as recited in claim 11, wherein the electric plug further comprises a grounding prong.

17. The duck head connector as recited in claim 11, wherein the connector is a C7 and the electric plug is selected from the group consisting of a Type A, a Type B, a Type C, a Type D, a Type E, a Type F, a Type G, a Type H, a Type I, a Type J, a Type K, a Type L, and a Type M.

18. The duck head connector as recited in claim 11, wherein the electric plug further comprises a bottom portion positioned at an end of the plug opposite the first prong and the second prong, the bottom portion including one or more latches positioned along a circumference of the bottom portion, further comprising a substantially rectangular latch plate positioned inside the housing and adjacent the second side, the latch plate forming a latch plate opening fitting the bottom portion and having one or more locking features formed along the circumference of the latch plate opening, the one or more latches engaging the one or more locking features and securing the electric plug to a position within the range of rotation.

19. The duck head connector as recited in claim 18, further comprising an inner housing positioned on the inside of the housing, the inner housing including a base and two or more arms extending from the first side to the second side, the base securing the first contact and the second contact, and the two or more arms supporting the latch plate.

20. The duck head connector as recited in claim 11, further comprising an inner housing positioned on the inside of the housing, the inner housing including a base and two or more arms extending from the first side to the second side, the base securing the first contact and the second contact, and the two or more arms supporting the electric plug.

21. A duck head connector, comprising:

a housing;

a connector for connecting to a power adapter, the connector positioned on a first side of the housing, the connector having a first contact and a second contact;

a first removable electric plug positioned on a rotating face of a second side of the housing, the second side forming an opening fitting a bottom portion of the first removable electric plug, the first removable electric plug including a first prong, a second prong, a first spring contact fastened to the first prong, and a second spring contact fastened to the second prong, the first removable electric plug rotating about the second side within a range of rotation, wherein the bottom portion of the first removable plug is configured to lock with the opening of the second side, wherein the first prong and the second prong are arranged within the first electric plug according to a first type of the first removable electric plug;

a first half-ring contact being substantially curve shaped and housed within the housing, the first spring contact swiveling along an inner surface of the first half-ring contact and maintaining a connection with the first half-ring contact as the first removable electric plug rotates;

a second half-ring contact being substantially curve shaped and housed within the housing, the second spring contact swiveling along an inner surface of the second half-ring contact and maintaining a connection with the second half-ring contact as the first removable electric plug rotates;

a first flexible insulated wire housed in the housing, the first flexible insulated wire connecting the first half-ring contact to the first contact;

a second flexible insulated wire housed in the housing, the second flexible insulated wire connecting the second half-ring contact to the second contact, wherein the first half-ring contact, the second half-ring contact, the first flexible insulated wire, and the second flexible insulated wire remain stationary as the first removable electric plug rotates and as the first spring contact and the second spring contact swivel along the inner surface of the first half-ring contact and the inner surface of the second half-ring contact; and a second removable electric plug including a third prong, a fourth prong, a third spring contact fastened to the third prong, a fourth spring contact fastened to the fourth prong, and a bottom portion of the second removable electric plug configured to lock with the opening of the second side, wherein the third prong and the fourth prong are arranged within the second removable electric plug according to a second type of the second removable electric plug, wherein the first removable electric plug is configured to be unlocked from the opening of the second side and replaced by the second removable electric plug, wherein the third spring contact and the fourth spring contact swivel along the inner surface of the first half-ring contact and the inner surface of the second half-ring contact as the second removable electric plug rotates.

* * * * *